United States Patent [19]

Dandy, III et al.

[11] Patent Number: 5,072,970

[45] Date of Patent: Dec. 17, 1991

[54] PERFORMANCE ENHANCEMENT ASSEMBLY FOR SKIERS OR THE LIKE

[75] Inventors: Walter Dandy, III; Tony Nespor, both of Baltimore, Md.

[73] Assignee: Ski Technology Holdings, Inc., Baltimore, Md.

[21] Appl. No.: 644,240

[22] Filed: Jan. 22, 1991

[51] Int. Cl.[5] ..... A63C 5/00; A63C 9/00

[52] U.S. Cl. ..... 280/811; 280/809; 280/11.36; 280/821; 2/23; 434/253

[58] Field of Search ..... 280/809, 811, 812, 816, 280/11.36, 821, 637; 2/22, 23, 303, 304, 314; 434/253

[56] References Cited

U.S. PATENT DOCUMENTS

| | | | |
|---|---|---|---|
| 899,963 | 9/1908 | Ferguson | 280/11.36 X |
| 1,812,383 | 6/1931 | Thompson | 280/11.36 |
| 3,928,872 | 12/1975 | Johnson | 280/11.36 X |
| 3,994,511 | 11/1976 | Gronseth | 280/637 X |
| 4,021,053 | 5/1977 | Willi | 280/11.36 |
| 4,058,326 | 11/1977 | Foulin | 280/11.36 X |
| 4,265,462 | 5/1981 | Willi | 280/11.36 X |
| 4,408,600 | 10/1983 | Davis | 280/11.36 X |
| 4,759,570 | 7/1988 | Dandy, III | 280/812 |

FOREIGN PATENT DOCUMENTS

| | | | |
|---|---|---|---|
| 2238038 | 2/1973 | Fed. Rep. of Germany | 280/11.36 |
| 2718939 | 11/1978 | Fed. Rep. of Germany | 280/11.36 |
| 426891 | 11/1947 | Italy | 280/809 |
| 191261 | 4/1937 | Switzerland | 280/809 |

*Primary Examiner*—Andres Kashnikow
*Assistant Examiner*—Brian L. Johnson

[57] ABSTRACT

An apparatus for shifting the body weight of a skier from a skier's legs to the skis for enhancing the skier's performance and minimizing leg strain comprises a spring assembly including a loop of elastic rod-shaped material stretchable during crouching movement of a skier's legs between a standing position and a fully crouched position of the skier. A housing defining an elongated channel for enclosing a portion of the loop supports the stretchable material and parallel rod-shaped branches terminating in a base bend. The base bend is secured within one end of the housing. The housing also includes a socket for receiving rigid poles therein and supporting the poles in vertical positions above the skis. The top ends of the poles have pulleys therein over which a cord is fed extending from a top bend of the loop or elastic material to straps disposed about the thigh or thighs of the skier's legs. The housing is secured to the back of the boots of the skier so that the skier's weight transferred to the rigid poles is in turn transferred to the skis.

4 Claims, 12 Drawing Sheets

PERFORMANCE ENHANCEMENT ASSEMBLY FOR SKIERS OR THE LIKE

BACKGROUND OF THE INVENTION

The present invention relates to a performance enhancing assembly for skiers or snowboarders. More specifically, the present invention relates to an assembly which shifts the upper body weight of a skier or snowboarder from their legs to the skis or snowboard during crouching movement of their legs between a standing position and a fully crouched position.

Skiing has been a very popular sport for many years. The sport is enjoyed by virtually all age groups, and the ski season extends for most of the year for the majority of skiers and the entire year for the world traveler. Due to the popularity of skiing, a major world industry has developed for ski equipment. In recent years ski equipment has advanced significantly to enhance skiing performance and safety. The skier and manufacturers of ski equipment are constantly looking for innovations in the standard ski components which will enhance the performance of skiers and make the sport even more pleasurable. Additionally, a lot of attention has been given to the need for better conditioning of skiers to enhance their performances and extend their hours of enjoyable skiing over the course of a typical vacation.

Skiing generally and turning techniques particularly, place unusual strain on the skiers legs. Consequent fatigue is painful and decreases skiing time and the enjoyment of the sport. A substantial amount of the strain on the legs is caused by the upper body weight of the skier and the impact of the skis on the ski slope. While great strides have been made in designing good exercise routines to prepare the skier for the strain experienced on the skiers legs during the skiing, these exercise routines do not completely prepare even the most diligent exercisers for the real life conditions one would experience on a mountain trail. Because many skiers are unprepared for these real life conditions the result in fatigue increases the risk of injury and decreases the skiers performance and enjoyment.

However, even with proper conditioning and following many days of skiing under real conditions, a skiers legs are still subject to a tremendous amount of strain and pressure. Even the professional downhill racers experience this strain and fatigue and are in search of ways to enhance their skiing performance. Furthermore, the older or less conditioned the skier, the greater amount of strain on the legs.

Snowboarding has also become a very popular sport in recent years. Snowboarding is performed primarily by teenagers and the young and those who are inclined to jump and acrobatically navigate slopes or half pipes. Even these young snowboarders experience leg strain and fatigue. This fatigue of course limits their jumping and acrobatics. Accordingly, snowboarders as well as skiers have a need for an assembly which could enhance their performance by lessening the strain on their legs.

An excellent performance enhancement assembly is described in U.S. Pat. No. 4,759,570 to Walter Dandy, III (a co-inventor of the present invention) issued Jul. 26, 1988. The Dandy assembly makes use of a rigid pole and spring assembly combination which transfers the weight of the upper body of a skier from the skiers legs to the skis during crouching movement of a skier. The Dandy assembly was a revolutionary breakthrough in this area and performs exceptionally well to reduce leg fatigue in skiers and enhance their performance. However, the preferred spring assembly in the Dandy apparatus in spite of its general effectiveness has certain potential disadvantages in practice. For example, the metal spring bands will not tolerate slack caused by sudden changes in positions of the skier's legs. The Dandy assembly of the '570 patent also has a limited lifetime since it is subject to breaking caused by quick recoil of the steel bands and the sharp edges on these spring bands could be hazardous. Furthermore, the Dandy '570 spring assembly is relatively heavy and bulky, relatively expensive to manufacture.

SUMMARY OF THE INVENTION

Accordingly, it is a primary object of the present invention to provide a system for enhancing the performance of a skier or snowboarder which has an improved spring assembly over that disclosed in U.S. Pat. 4,759,570 to Dandy.

It is another object of the present invention to provide a more compact and reliable spring assembly in a performance enhancement system of the type disclosed in the Dandy '570 patent.

It is yet another object of the present invention to provide a less expensive spring assembly for use in a skier performance enhancement system of the type described in the Dandy '570 patent.

It is a further object of the present invention to provide unique coupling means between the spring assembly of the present invention and the adjacent components of the performance enhancement system to which the spring is attached, which is not subject to failure or breakage for prolonged periods of time.

It is yet another object of the present invention to provide a unique harness and pants design for use with the performance enhancement system of the present invention which is worn about the thighs and torso of the user in a comfortable fashion, and with an aesthetically pleasing appearance.

The objects of the present invention are fulfilled by providing an apparatus for shifting the body weight of a skier from the skier's legs to a skier's skis through the skier's boot or boots as the skier crouches over the ski or skis comprising: a spring assembly including a loop of elastic rod-shaped material stretchable during crouching movement of a skiers legs between a standing position and a fully crouched position of the skier, a housing defining an elongated channel for enclosing a portion of said loop for stretchable longitudinal movement and parallel rod-shaped branches terminating in a base bend, means for securing the base bend of the loop within the housing; a socket defined by said housing of the spring assembly; rigid pole means having a bottom end detachably supported in said socket and a top end with a bearing therein; a cord having a bottom end connected to a top bend of the loop of rod-shaped elastic material which is not enclosed within said housing, said cord extending vertically over said bearing and terminating in a top end; strap means disposable about the thigh or thighs of a skier's legs connected to the top end of said cord; and means for supporting the housing of the spring assembly on the boot or boots of the skier; whereby said spring assembly supports a portion of the skier's body weight as a skier crouches during skiing, thereby shifting that portion of body weight from the skier's legs to the ski or skis through the skier's boot or boots.

The base and top bends of the loop of elastic rod-shaped material are thickened to provide a larger cross-section than adjacent portions of the loop in order to strengthen the loop at these portions where connections are made to adjacent components of the performance enhancement system. Since in a preferred embodiment the loop of elastic rod-shaped material is rubber these thickened portions are provided by molding the loop with thicker rubber portions at these connection regions.

The rubber loop is securely held within the spring assembly housing by feeding the loop and the lower bend thereof through the elongated slot. The housing has a removable cover portion adjacent the bottom and a threaded transverse aperture for receiving a threaded bolt. The lower bend of the rubber loop is fed over the bolt. That is, when the cover is in place the bolt extends through the housing within the loop and in juxtaposition to the lower bend. Therefore, the bolt restrains the lower bend from movement within the housing.

The thickened portion of the upper bend of the loop is coupled through a special connector to cords which pass over bearings on the top of the rigid poles for attachment to the harness on the thighs of the skier. The special connector includes a U-shaped wire member through which the upper bend of the loop is fed and has two prongs which snap fit into a plastic connector having mating apertures. The top portion of the plastic member has an eyelet portion to which the cord is attached.

The body harness of the present invention may be worn under the pants of the skier if the pants are provided with properly positioned eyelets disposed a predetermined distance above the points of attachment of the cords on the skiers thighs, so that the cords may be fed through these eyelets and attached to the harness.

The present invention also provides a specially designed handle for ski poles including a cylindrical channel, a bias spring and a latch to enable the rigid poles of the performance enhancement system of the present invention to be snap fit into the channels and completely recessed therein during traveling by the skier up a ski lift.

It should be understood that the term skier used herein is intended to include downhill skiers, cross-country skiers, snowboarders, water skiers or the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
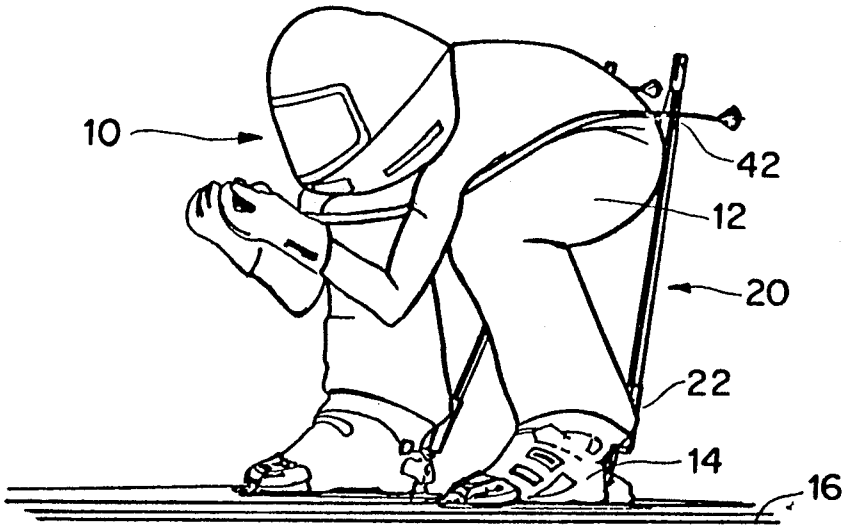
FIG. 1 is a perspective view illustrating a skier such as a downhill racer in a full tuck position utilizing the performance enhancement system of the present invention.

The performance enhancement system of the present invention may be best illustrated by reference to FIG. 1 in combination with FIGS. 6A, 6B and 6C. As illustrated therein a skier, such as a downhill racer 10 in a full tuck position is crouched over his skis 16 as he skis down a mountain trail. The performance enhancement system of the present invention is generally indicated 20 and comprises a spring assembly housing 22 coupled to the boots 14 of the skier through a bracket 24, a rubber loop or spring 40 of elastic rod-shaped material extending within and from housing 22, a special connector 42 coupling the spring 40 to a cord 50, rigid poles 41 having a top end 41A with a pulley 41B journaled therein providing a bearing surface for cord 50 and a harness 60 for securing cords 50 through hook fasteners 52 to appropriate rings 68 and 70 on the harness 60.

Figure 5B:
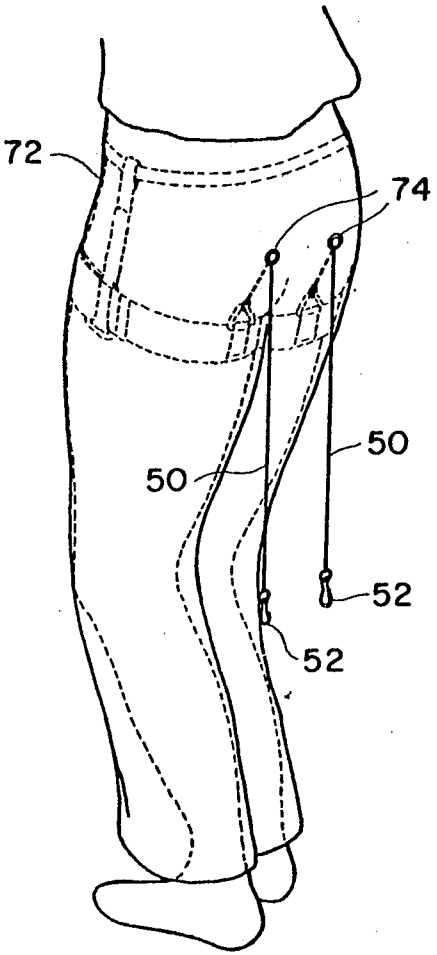
FIG. 5B illustrates a special embodiment of ski pants designed for use with the system of the present invention disposed over the harness of FIG. 5A.
Figure 5A:
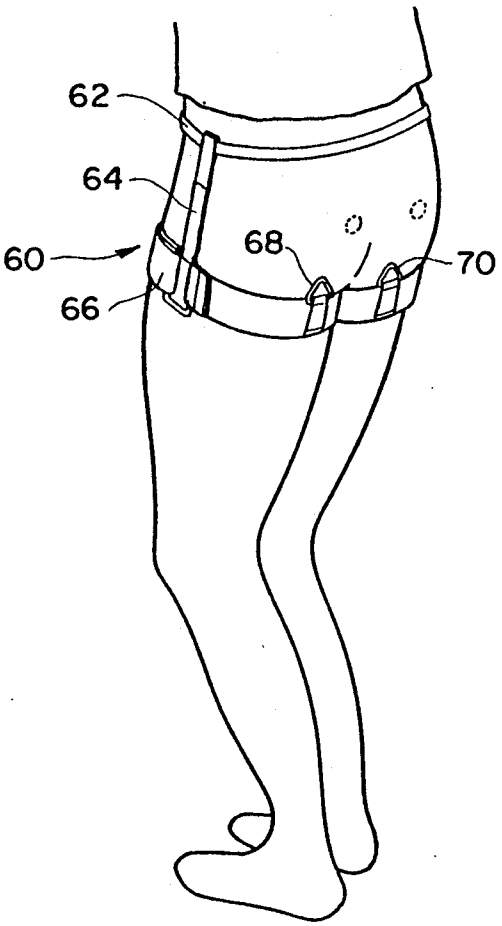
FIG. 5A illustrates a harness to be worn by a skier utilizing the performance enhancement system of the present invention over the skiers undergarment such as thermal underwear.

More detail of the harness 60 is illustrated in FIGS. 5A and 5B which shows a waist strap 62 connected to a pair of thigh straps 66 by vertical straps 64. In FIG. 5A the harness 60 is illustrated as worn on a skier over the skiers undergarment such as thermal underwear. As illustrated in FIG. 5B special ski pants are designed in accordance with the present invention including grommets 74 therein disposed at an appropriate position above thigh strap 66 so that cord 50 may be fed therethrough for attachment to attachment rings 68 and 70. The distance of grommets 74 above leg strap 66 are selected so that during skiing the ski pants 72 will not bunch up, or ride up, on the skier as cord 50 moves in and out through the eyelets during the respective possible positions of the skier illustrated in FIGS. 6A to 6C.

Figures 6A, 6B, 6C:
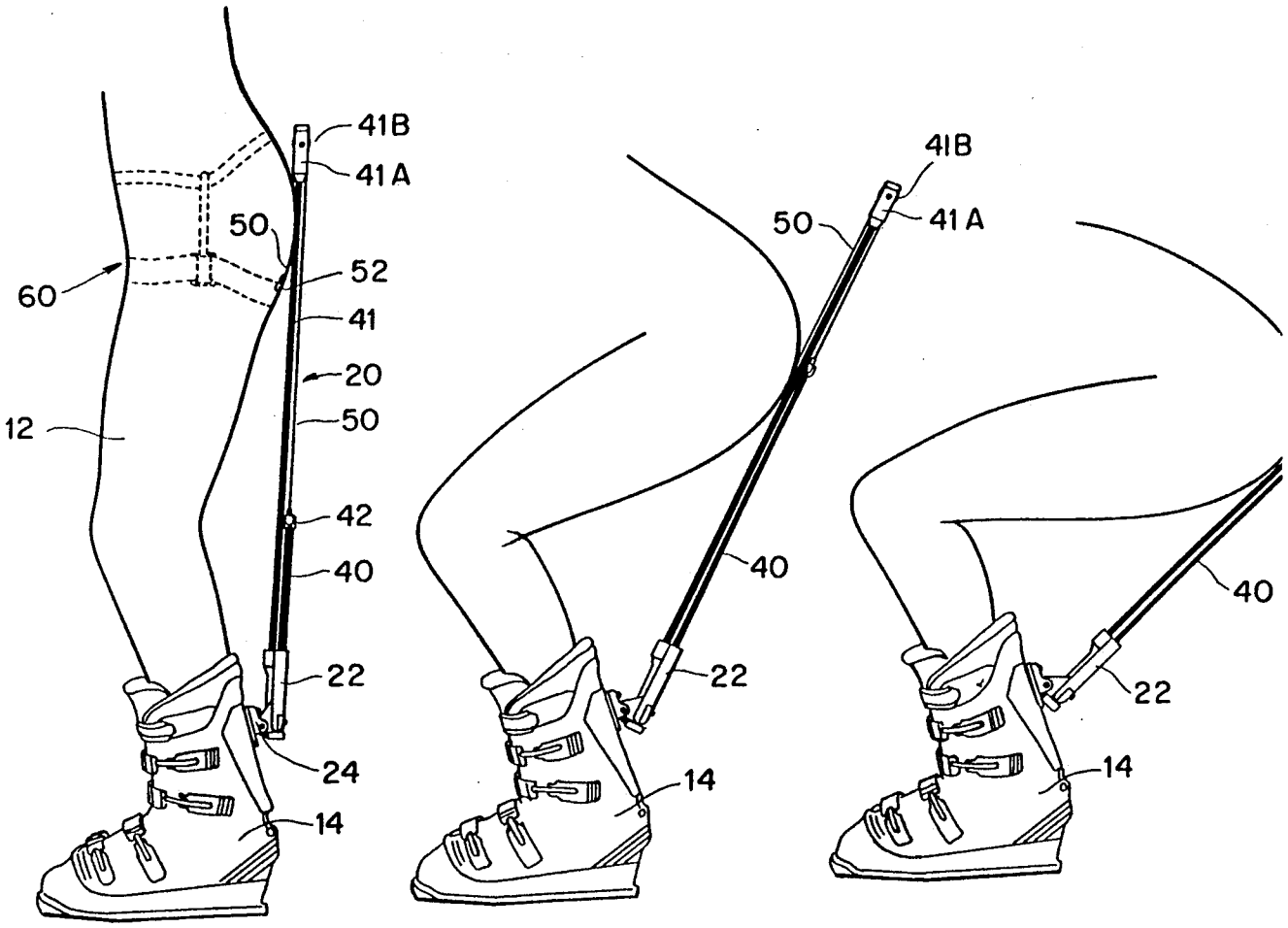
FIG. 6A illustrates the performance enhancement system of the present invention attached to a skier with a skier in a full standing position.
FIG. 6B illustrates the system of the present invention attached to a skier with a skier in a partially crouched position.
FIG. 6C illustrates the enhancement system of the present invention connected to a skier with a skier in a fully crouched position similar to that of FIG. 1.
Figure 7A:
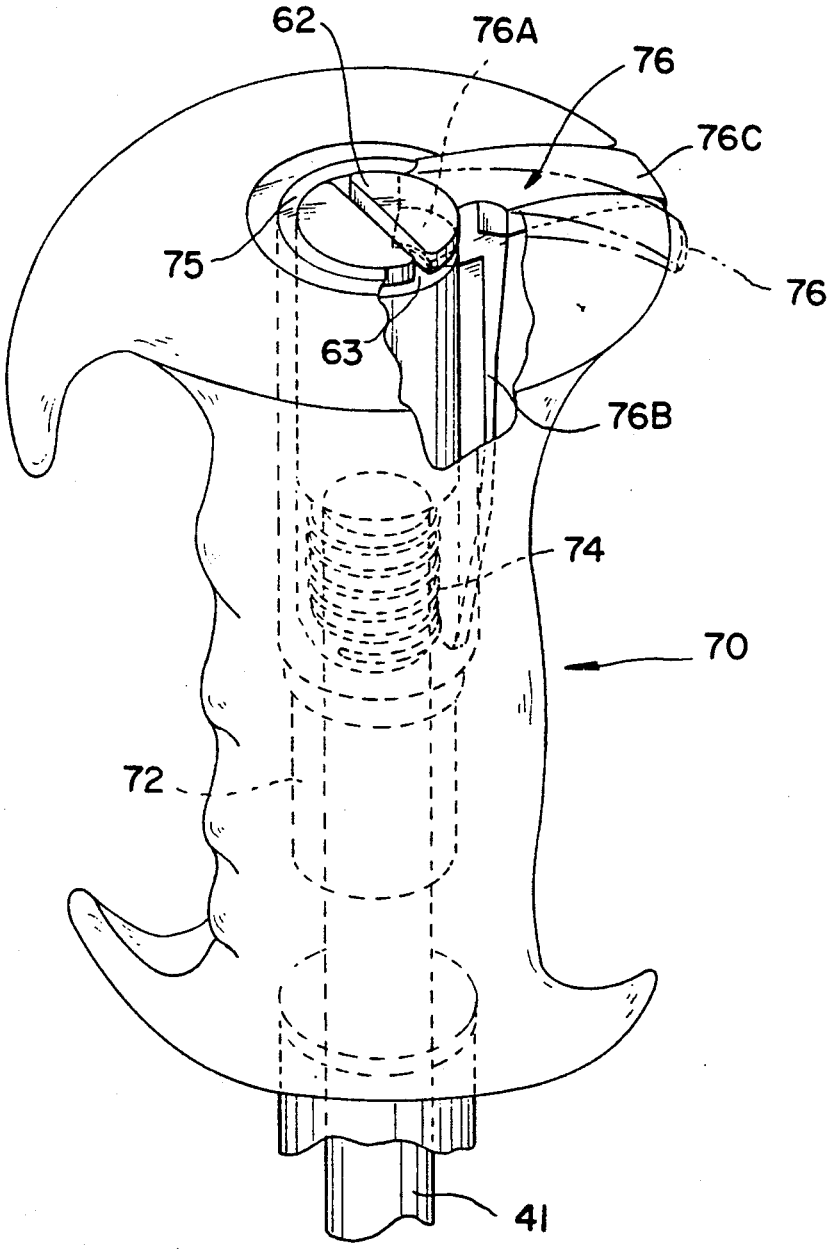
FIG. 7A to 7D illustrate a special construction of a handle of a ski pole for use in storing one of the rigid poles of the enhancement system of the present invention.
Figure 7B:
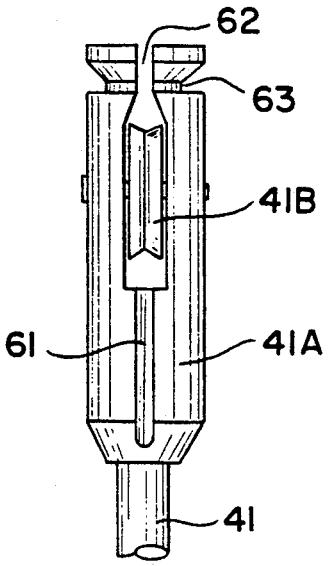
Figure 7C:
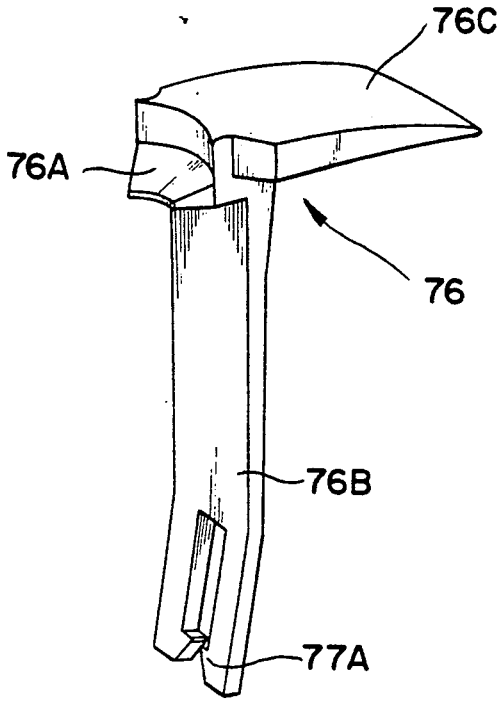
Figure 7D:
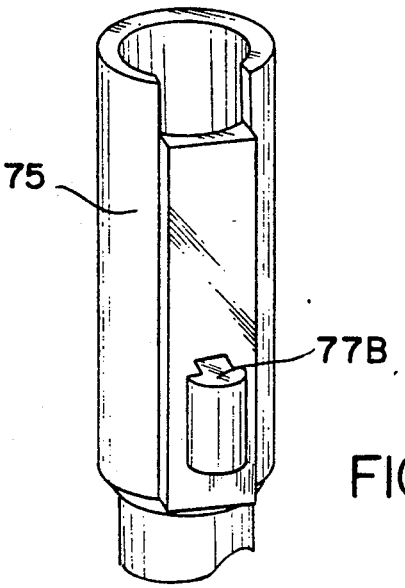

Referring in more detail to FIG. 6A, 6B and 6C the operation of the performance enhancement system of the present invention is illustrated. In the position of 6A with the skier in essentially a full standing position spring 40 is only partially extended so that cord 50 is taut but the skiers legs 12 are essentially supporting all of the skiers upper body weight. In a partially crouched position such as in FIG. 6B as the skier bends his legs cord 50 is pulled over the bearing surface of pulley 41B and spring 40 is further extended. In this position a substantial amount of the upper body weight of the skier is transferred through rigid poles 41 disposed in a socket of housing 22 to be described hereinafter and the skiers boots 14 to the skis 16 or the like. It should be understood that the skis 16 could also be a snowboard without departing from the spirit and scope of the present invention. In the position illustrated in FIG. 6C the skier is in a fully crouched position such as the tuck position of the downhill racer of FIG. 1 which is a particularly strenuous position. However, with the performance enhancement system of the present invention, and particularly the special design of the spring assembly, strain to the legs of the skier is significantly reduced.

The performance enhancement system of the present invention and particularly the improved spring assembly is illustrated in more detail in FIGS. 2 and 3. FIG. 2E illustrates the rubber loop rod-shaped spring of the present invention which is a continuous loop 40 having an upper bend 40A and a lower bend 40B. These bend portions 40A and 40B are thickened to provide a larger cross-section since connection to the housing 22 and the special connector 42 is made at these thickened portions. Therefore, this extra mass of rubber makes the spring 40 more durable at bends 40A and 40B and less likely to tear or fracture. Without these thickened portions the bends are subject to breaking due to increased stretching of the rubber at the points of attachment within housing 22 and to connector 42.

Figure 2A:
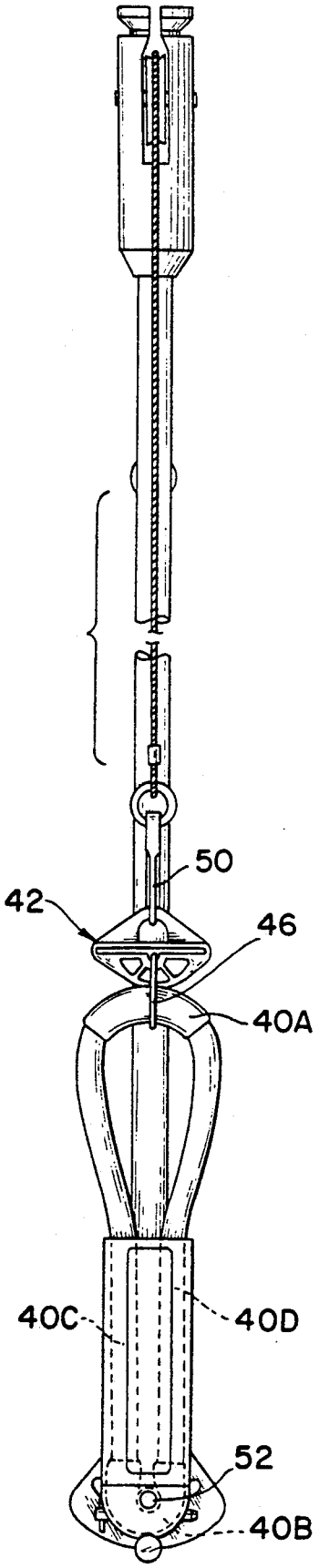
FIG. 2A is a front elevational view of a substantial portion of the performance enhancement system of the present invention.

The loop 40 is inserted into housing 22 as illustrated in FIG. 2A with the lower bend 40B encircled around a bolt 52 (FIG. 3H) which is threaded into a threaded socket 51. Bolt 52 may also be covered with a plastic sleeve. An opening in the housing 22 is covered by a removable lid 60 secured to housing 22 by bolt 52 through aperture 62. When lid 60 is in place it clamps the lower bend 40B of rubber loop 40 firmly in place within housing 22. A major portion of loop spring 40 is contained within an oval-shaped channel 38 in housing 22 as illustrated in FIGS. 3. Referring again to FIG. 2A with loop spring 40 within housing 22 two parallel branches 40C and 40D exist and are extensible and retractable within channel 38 of housing 22 which acts as a guide. The upper bend 40A of loop 40 extends out of housing 22 and is coupled by the special connector 42 to the cord 50 to be described in more detail hereinafter.

Figure 2B:
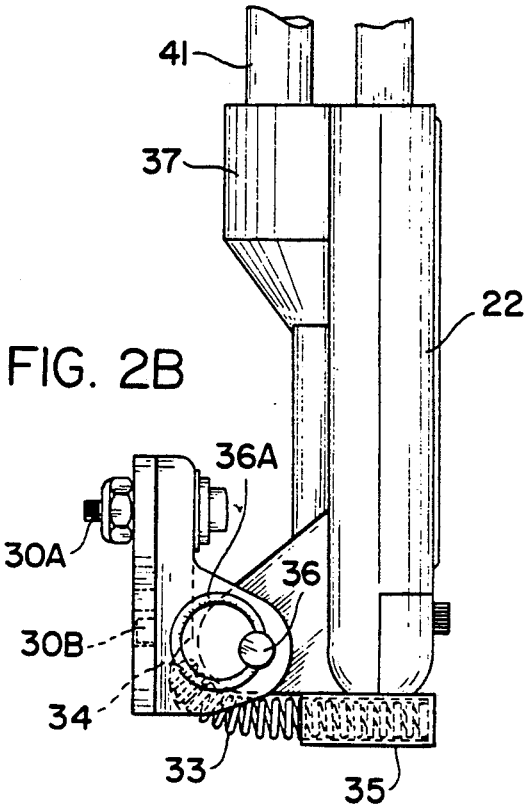
FIG. 2B is a left side elevational view of the system of FIG. 2A.
Figure 2C:
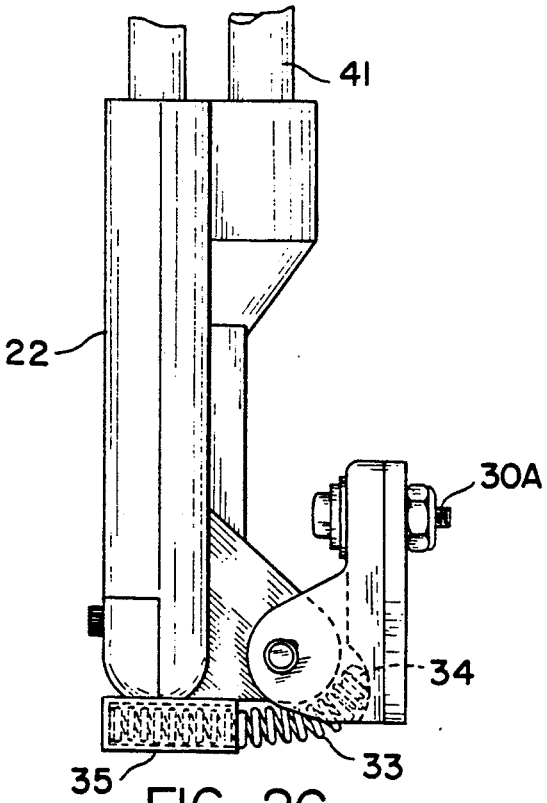
FIG. 2C is a right side elevational view of the system of FIG. 2A.
Figure 2D:
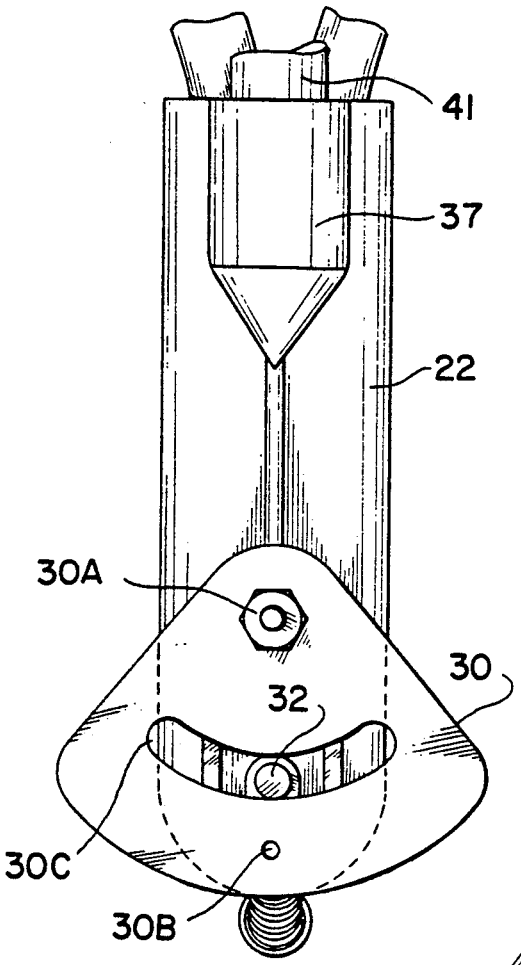
FIG. 2D is a rear elevational view of the system of FIG. 2A.
Figure 2E:
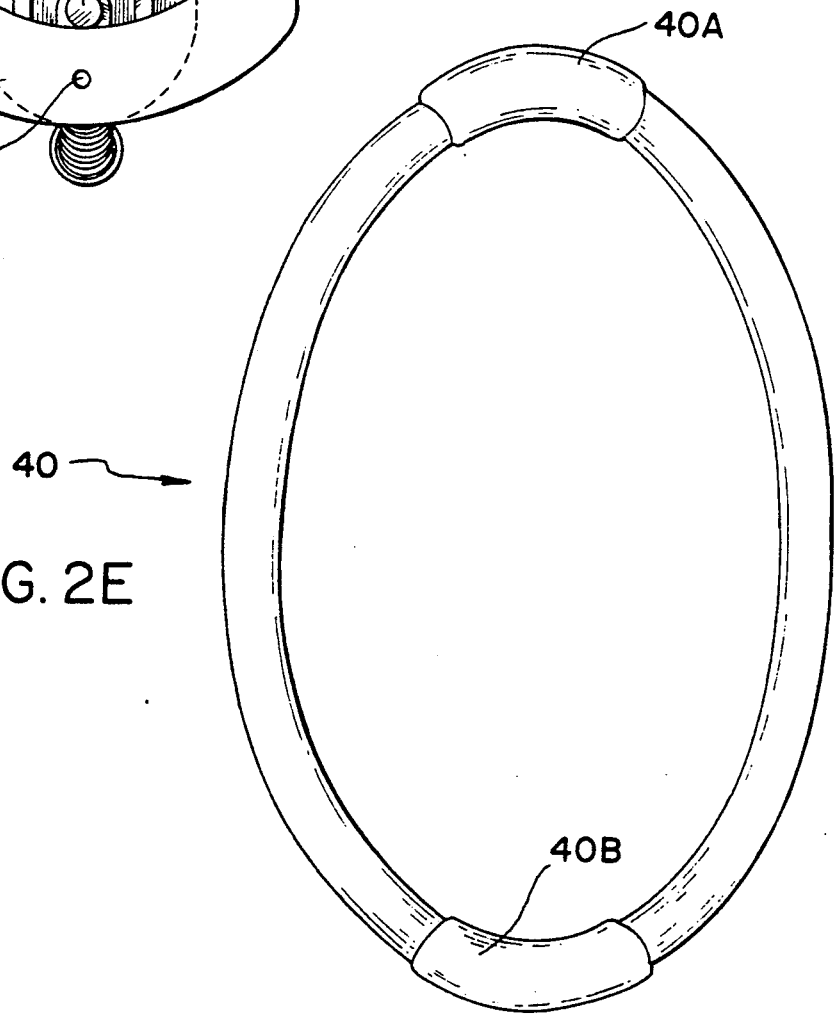
FIG. 2E is a plan view of a preferred embodiment of the rubber rod-shaped spring of the present invention.
Figure 3C:
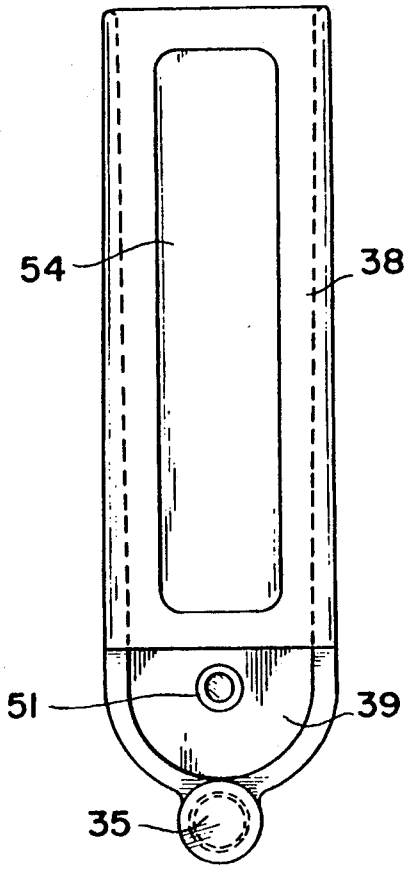
FIG. 3C is a front elevational view of the housing of FIG. 3A.
Figure 3B:
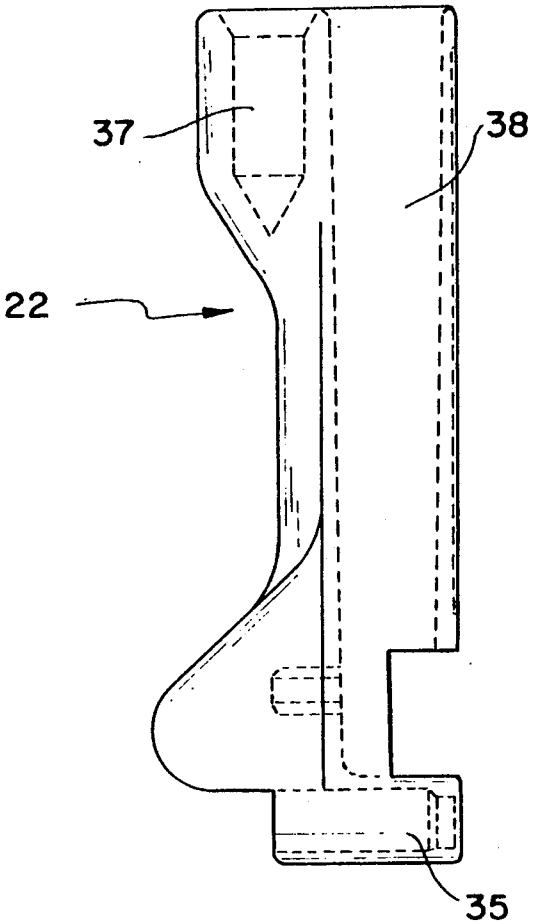
FIG. 3B is a right side elevational view of the housing of FIG. 3A.
Figure 3A:
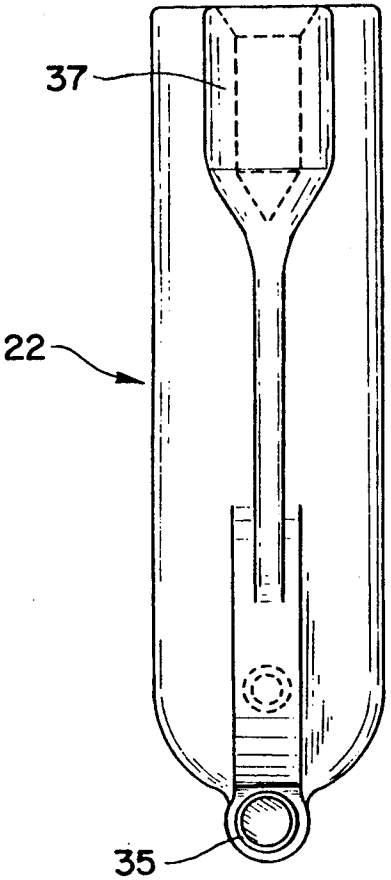
FIG. 3A is a rear elevational view of the spring assembly housing of the present invention.
Figure 3D:
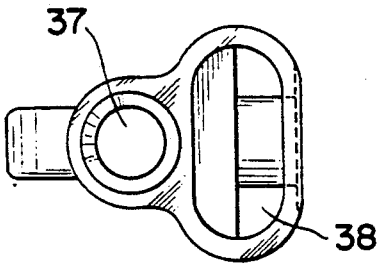
FIG. 3D is a top plan view of the housing of FIG. 3A.
Figure 3E:
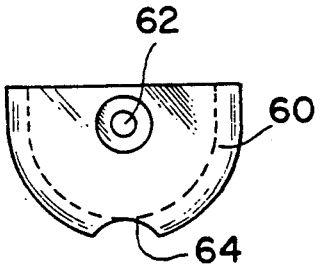
FIG. 3E is a top plan view of a cover portion of the housing of FIG. 3C.
Figure 3F:
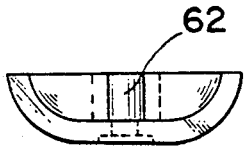
FIG. 3F is a rear elevational view of the cover of FIG. 3E.
Figure 3G:
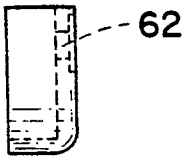
FIG. 3G is a right-side elevational view of the cover of FIG. 3E.
Figure 3H:
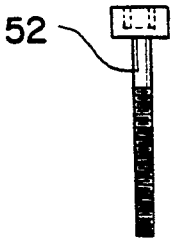
FIG. 3H illustrates a bolt for securing the cover plate for FIG. 3E to the spring assembly housing.

The bottom of housing 22 is mounted on a swivel bracket 30 best illustrated in FIGS. 2B, 2C and 2D. Swivel bracket 30 is in turn secured to the boots 14 of the skier or the like through an appropriate screw fastener 30A and a screw inserted through aperture 30B. Therefore, the bracket 30 is fixed to the rear of the boots of the skier. However, the housing 22 is free to pivot about screw 30A as a pivot point and a post 32 is provided on a lower wall of housing 22 for mating with an arcuate slot 30C in bracket 30. This enables the housing 32 to swivel side-to-side with movements of the skier so that the skier is not inhibited or precluded from planting a firm edge of the skis in snow or ice during turning maneuvers.

Figure 8:
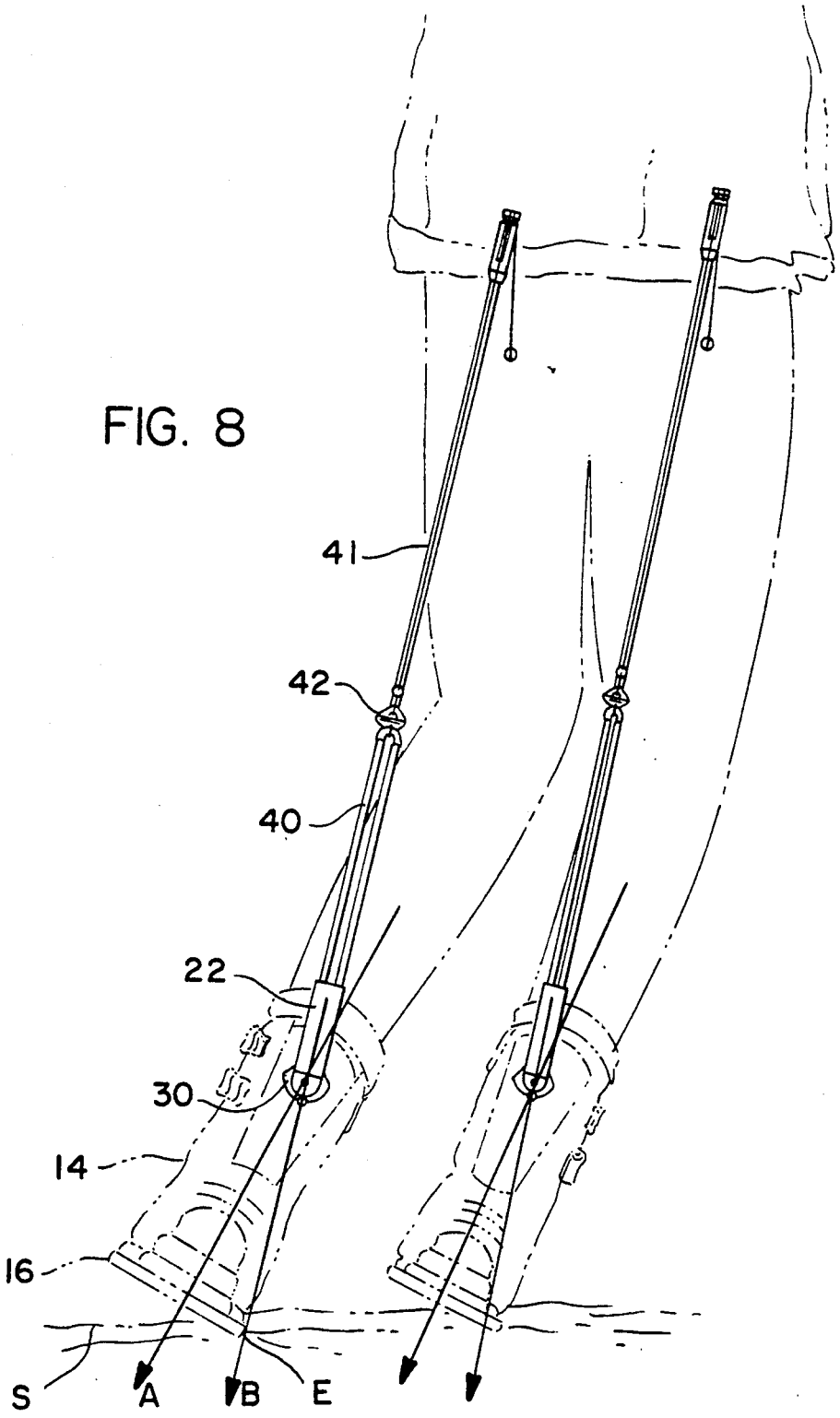
FIG. 8 illustrates the operation of the swivel interface between a skier's boot and the spring assembly housing.

The operation of the swivel bracket 30 is illustrated in FIG. 8 which shows the assembly of the present invention attached to a skier during the execution of a turn. In the position shown the skier's body is angulated with respect to surface S. This position is the most effective position for forcing the downhill skis edge E into the slick snow surface S. If not for the swivel 30 the rods 41 would be forced into a bow and would try to flatten out the ski, forcing it to relinquish some of its edge. A force line without swivel 30 is indicated by arrow A in FIG. 8. With swivel 30 the force line into surface S is indicated by arrow B. Thus, with swivel 30 the force line B instead of thwarting a good edge, drives the edge into a slick surface, such as ice, and holds the edge beyond the normal capability of the skier.

The bracket 30 also permits pivoting of the housing 22 forward and backward of the skier about a pivot pin 36 as illustrated in FIG. 2B. Pivot pin 36 extends through an aperture in the bracket 30 and includes a ring 36A which enables a skier to pull the pin out to detach the housing 22 from the bracket 30 when it is desired to ski without use of the system of the present invention. In order to normally maintain housing 22 in a substantially vertical position with respect to the back of the skier's boots, a coil spring 33 with a rounded bearing tip 34 is provided. The bearing tip 34 fits into an arcuate slot in the bottom of bracket 30 and the opposite end of coil spring 33 fits into socket 35 on the bottom of housing 22. As can be seen in FIG. 2B housing 22 will then pivot front-to-back against the force of coil spring 23.

The details of construction of housing 22 can be better understood with reference to FIGS. 3A, 3B, 3C and 3D in conjunction with the illustrations of FIGS. 2A to 2E described above.

Figure 4A:
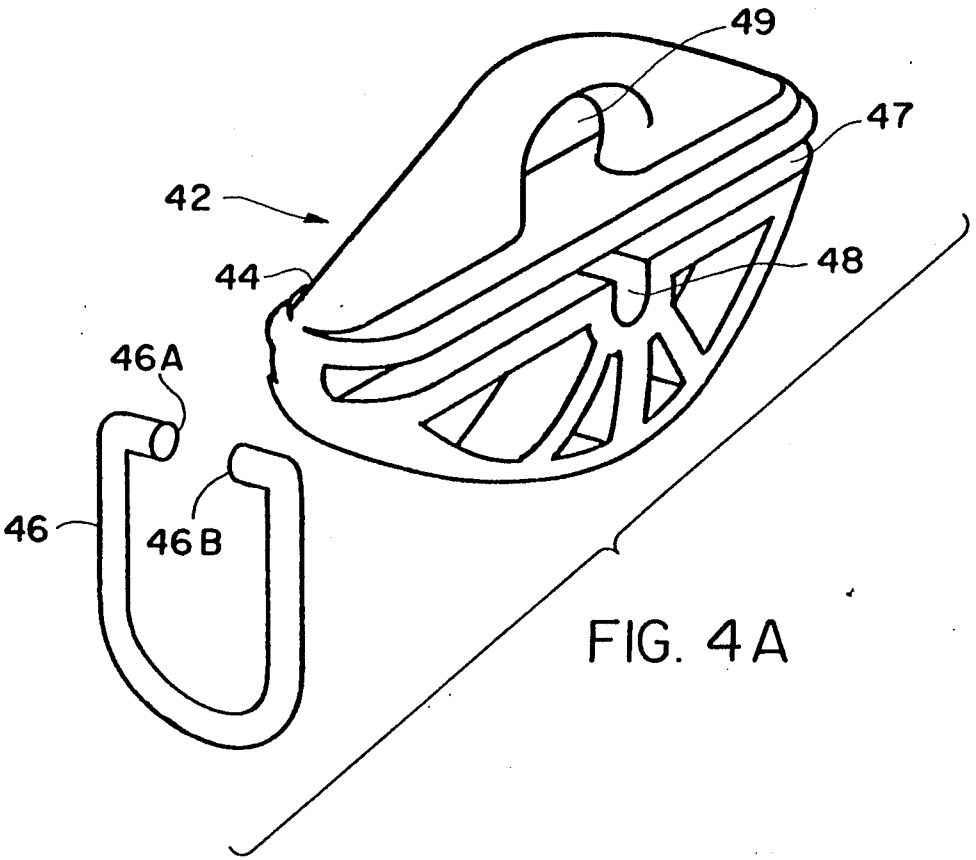
FIG. 4A is an exploded view of the special connector of the present invention for connecting the spring assembly and cord over the rigid support poles to the thighs of the skier.
Figure 4B:
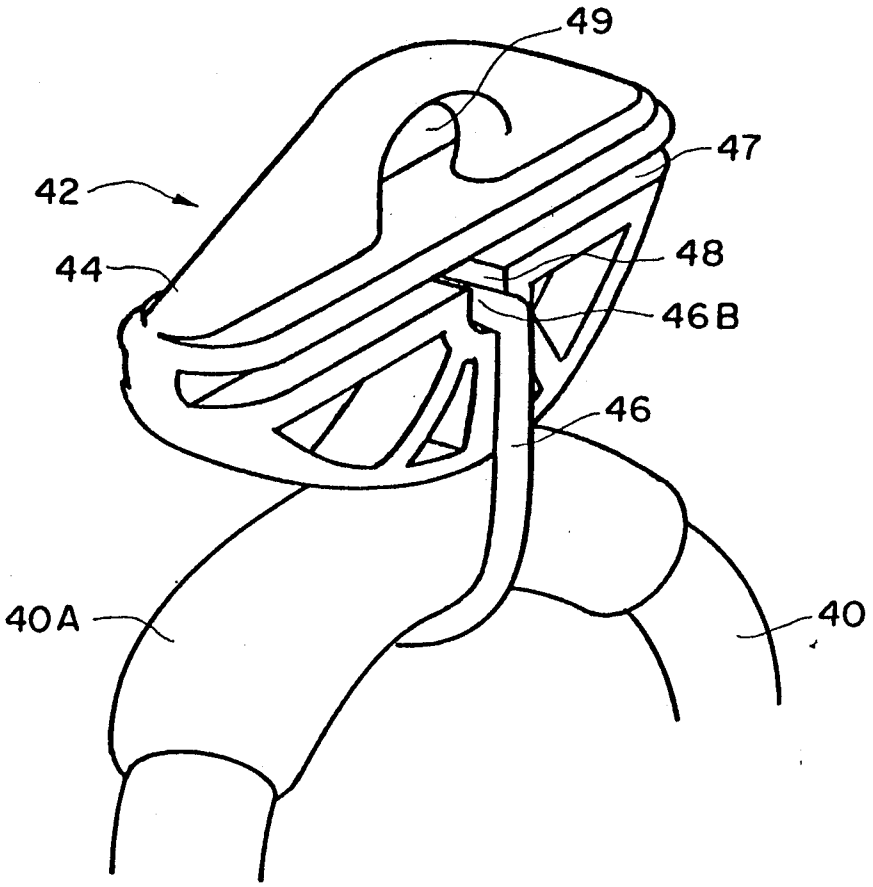
FIG. 4B shows the special connector of FIG. 4A assembled and connected to the top bend of the rubber spring assembly of the present invention.

A special connector for connecting cord 50 to the upper bend 40A of spring 40 is illustrated in FIGS. 4A and 4B. The special connector 42 includes an upper plastic portion 44 having an aperture 49 attachable to cord 50 with an appropriate hook, a slot 47 and retaining apertures 48. The bottom portion of special connector 42 is a U-shaped wire member 46 having prongs 46A and 46B. In operation U-shaped wire member 46 encloses thickened portion 40A of rubber loop 40 and prongs 46A and 46B are slid into slots 47 on opposed sides of element 44. Prongs 46A and 46B then snap into apertures 48 to securely retain wire member 46 therein and about rubber loop 40. The construction of this special connector 42 provides for a quick connect or disconnect of spring 40 from cord 50 if desired.

Another special feature of the system of the present invention is illustrated in FIGS. 7A to 7D. When riding up a chair lift it is desirable for a skier to be able to remove the rigid poles 41 and store them within the handles and tubular shafts of their ski poles to avoid injury and inconvenience. Accordingly, the present invention includes a specially designed ski pole handle 70 including a tubular slot 72 with a coil spring 74 suitably fixed therein for engaging the upper portion 41A of the rigid poles when inserted in tubular slot or channel 72. Therefore, a skier in preparation for riding up on a chair lift would insert rigid poles 41 in each of his ski poles through tubular channel 72 and upper portions 41A would compress against coil spring 74. A retainer housing 75 for the latch mechanism fits within channel 72. A latch mechanism 76 is provided in the top portion of the handle and includes an upper horizontal arm 76C and a vertical arm 76B. The arms are made of plastic and the lower tip (fork 77A) of arm 76B is supported on a pivot point 77B on the retainer housing 75 within tubular channel 72. When pole 41 is inserted into channel 72 the skier presses on upper arm 76C to retract latch protrusion 76A by pivoting the latch 76 about the pivot point 77B as illustrated in the dotted lines of FIG. 7A. Once the pole 41 is inserted into position against the force of coil spring 74, latch 76 is released and latch protrusion 76A will snap into recess 63 which extends around the perimeter of the top portion 41A of pole, 41. In this manner the poles 41 are secure within the skiers ski poles.

When the skier reaches the top of the chair lift and is ready to make a run utilizing the performance enhancement system of the present invention the process is reversed and arm 76C of latch 76 is depressed releasing pole 41 which is then withdrawn from handle 70 and placed in socket 37 of housing 22. Cord 50 is then fed up through slot 61 of top portion 41A of pole 41 over pulley 41B through slot 62 and connected to the appropriate points on the thigh straps of the skier as previously described.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for shifting the body weight of a skier from the skier's legs to a skier's ski or skis through the skier's boot or boots as the skier crouches over the ski or skies comprising:

a spring assembly including a loop of elastic rod-shaped material stretchable during crouching movement of a skier's legs between a standing position and a fully crouched position of the skier, a housing defining an elongated channel for enclosing a first portion of said loop for stretchable longitudinal movement in parallel rod-shaped branches terminating in a base bend, and means for securing the base bend of the loop within the housing;

a socket defined by said housing of the spring assembly;

rigid pole means having a bottom end detachably supported in said socket and a top end with a bearing therein;

a cord having a bottom end connected to a top bend of the loop of rod-shaped elastic material at a second portion external of said housing, said cord extending vertically over said bearing and terminating in a top end;

strap means disposable about the thigh or thighs of a skier's legs connected to the top end of said cord; and means for supporting the housing of the spring assembly on the boot or boots of the skier;

whereby said spring assembly supports a portion of the skier's body weight as the skier crouches during skiing, thereby shifting that portion of body weight from the skier's legs to the ski or skis through the skier's boot or boots.

2. The apparatus of claim 1 wherein the base and top bends of said loop of elastic rod-shaped material are thickened to provide a larger cross-section than adjacent portions of said loop.

3. The apparatus of claim 2 wherein said loop of elastic rod-shaped material is rubber.

4. The apparatus of claim 1 wherein said loop of elastic rod-shaped material is rubber.

* * * * *